United States Patent [19]

Winge

[11] Patent Number: 4,768,497

[45] Date of Patent: Sep. 6, 1988

[54] ROCKING PLATFORM FOR WHEELCHAIRS

[76] Inventor: Donald J. Winge, 110 Cherry St., #110, Grand Forks, N. Dak. 58201

[21] Appl. No.: 47,461

[22] Filed: May 11, 1987

[51] Int. Cl.[4] ..... A61H 1/02

[52] U.S. Cl. ..... 128/25 R; 297/DIG. 4; 5/108

[58] Field of Search ..... 128/24 R, 25 R, 33, 128/35, 36; 272/146, 56; 297/260–270, DIG. 4; 280/242 WC, 289 WC; 108/6, 7, 22; 248/371, 372.1, 393–398; 5/109, 108

[56] References Cited

U.S. PATENT DOCUMENTS

| | | | |
|---|---|---|---|
| 404,767 | 6/1889 | Botkin | 280/30 |
| 745,334 | 12/1903 | Dutton | 280/43.15 |
| 1,743,904 | 1/1930 | Russell | 280/35 |
| 2,632,517 | 3/1953 | Fraunfelder et al. | 5/109 |
| 3,351,051 | 11/1967 | Jennings | 128/24 R |
| 3,403,905 | 10/1968 | Hamilton | 128/25 R |
| 3,653,080 | 4/1972 | Hafele | 5/108 |
| 4,118,046 | 10/1978 | Vaughan | 280/289 WC |
| 4,194,499 | 3/1980 | Donnelly, Jr. | 128/33 |
| 4,256,095 | 3/1981 | Graham | 5/109 |
| 4,324,414 | 4/1982 | Wilkes | 280/242 WC |
| 4,527,944 | 7/1985 | Qually et al. | 297/DIG. 4 |
| 4,592,695 | 6/1986 | McConnell | 297/DIG. 4 |

*Primary Examiner*—Richard J. Apley
*Assistant Examiner*—J. Welsh
*Attorney, Agent, or Firm*—Zarley, McKee, Thomte, Voorhees & Sease

[57] ABSTRACT

A rocking platform for wheelchairs includes a platform pivotally attached to a base housing, and sized to hold a standard wheelchair thereon. A retractable ramp on the forward edge of the platform allows a wheelchair to be easily rolled onto the platform. A lock bar with clamping devices on each end is attachable to the sides of the platform forward of the large rear wheels of the wheelchair to further secure the chair. A motor mounted in the housing powers the rocking action of the platform. The platform is easily stored and transported by tipping it up onto casters mounted on the rearward end of the housing.

8 Claims, 4 Drawing Sheets

ROCKING PLATFORM FOR WHEELCHAIRS

TECHNICAL FIELD

This invention relates generally to devices for rocking a wheelchair, and more particularly to an improved platform for adapting wheelchairs to rock with a motion analogous to that of a rocking chair.

BACKGROUND OF THE INVENTION

A person who relies on a wheelchair for mobility and transportation is restricted to rolling from place to place or back and forth in one place. The benefits provided by a rocking chair, and the dual motion occurring therein, are not available to those who are confined to a standard wheelchair.

The dual motion of a rocking chair, namely back-and-forth movement and up-and-down movement in one place, could provide many benefits to one who is dependent upon a wheelchair. Such benefits could include respiratory assistance, better blood circulation, and the reduction and/or control of sores caused from extended periods of sitting in one place. Furthermore, the restricted motion of the wheelchair may influence the occupant's stress, strain and emotional attitude. Freedom from this restricted motion, even for a short while, can be beneficial to the user's emotional attitude.

While certain wheelchairs have been specially adapted for particular needs—such as those adapted for sports activities with an adjustable center of gravity, and wheelchairs adapted to fit on lawn and garden tractors—such adaptations tyically require a completely redesigned wheelchair, and are not capable of use on more than one wheelchair. Similarly, devices such as the rocker assembly disclosed in U.S. Pat. No. 4,118,046, which may be installed on a standard wheelchair, are not easily used on more than one wheelchair.

It is therefore an object of the present invention to provide a rocking platform upon which a standard wheelchair may be rockably supported.

Another object is to provide a rocking platform for wheelchairs which transmits both the up-and-down and back-and-forth motions of the rocking chair to a wheelchair.

Still another object is to provide the motion of a rocking chair to any wheelchair without attaching structure to the wheelchair.

A further object of the present invention is to provide a rocking platform which may be accessed and operated by a person in a wheelchair.

Still another object is to provide a rocking platform which will secure any standard wheelchair therein.

Yet another object is to provide a rocking platform which is easily transportable.

Still a further object of the present invention is to provide a rocking platform which may be stored in a small space.

These and other objects will be apparent to those skilled in the art.

SUMMARY OF THE INVENTION

The rocking platform of this invention includes a platform which is pivotally attached to a base housing, and sized to hold a standard wheelchair thereon. A retractable ramp on the forward edge of the platform allows a wheelchair to be easily rolled onto the platform. Once retracted, the ramp forms an additional barrier to secure the wheelchair on the platform. A lock bar with clamping devices on each end is attachable to the sides of the platform forward of the large rear wheels of the wheelchair to further secure the chair. A motor mounted in the housing powers the rocking action of the platform. The platform is easily stored and transported by tipping it up onto casters mounted on the rearward end of the housing.

DESCRIPTION OF THE PREFERRED EMBODIMENT

Figure 1:
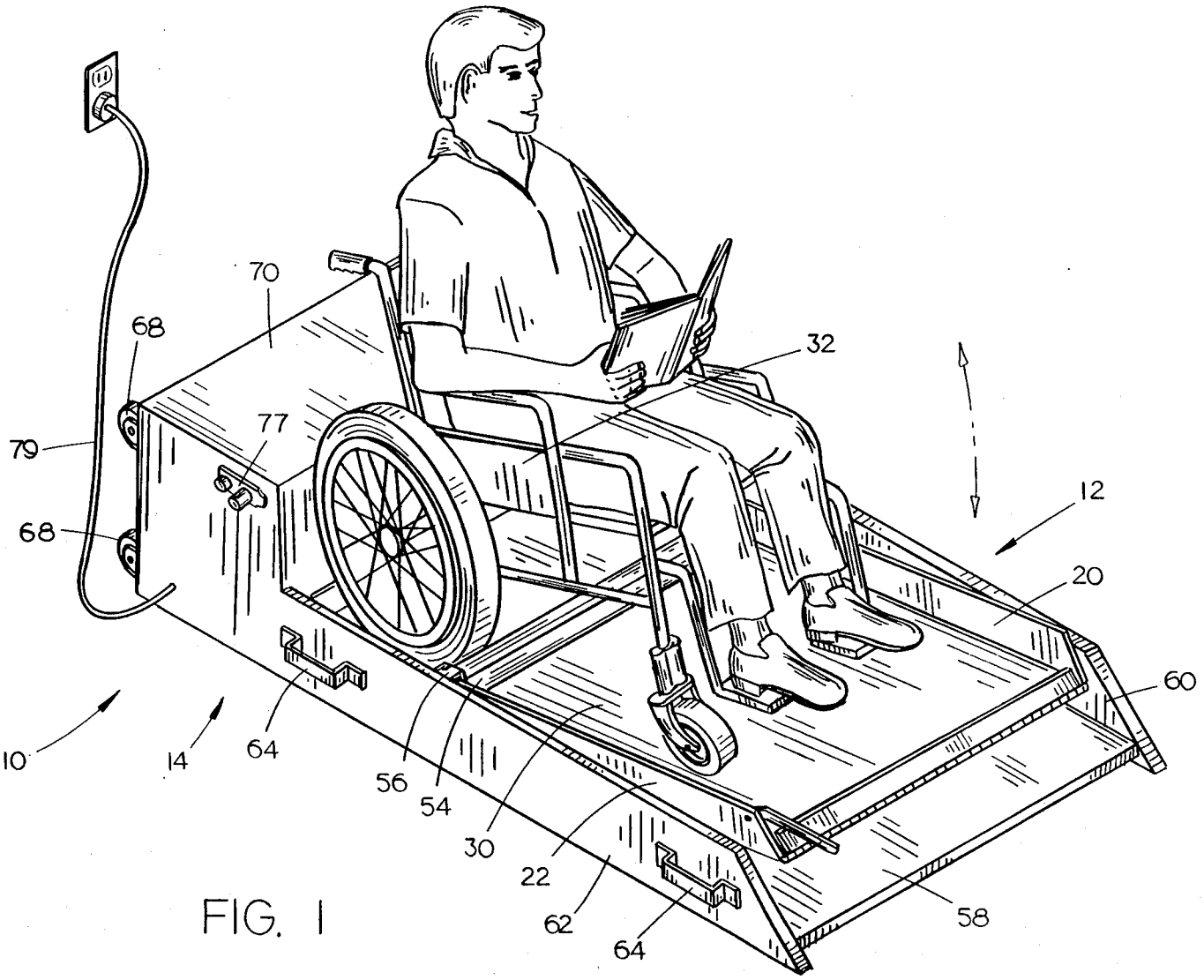
FIG. 1 is a perspective view of the invention in operation.

Referring now to the drawings, wherein similar or corresponding parts are identified with the same reference numeral, the rocking platform of this invention is designated generally at 10 and includes a platform assembly 12 pivotally attached to a ground-supported base housing 14, and includes a power train 16 connected to platform assembly 12.

Platform assembly 12 includes a frame 18 having right and left sides 20 and 22 formed from angle irons, a rearward end 24 formed of an angle iron and connecting the rearward ends of sides 20 and 22, a forward end 26 formed from rigid strap and connecting the forward ends of sides 20 and 22, and a series of spaced transverse members 28 connected between right and left sides 20 and 22. Sides 20 and 22, and rearward end 24, are mounted with one leg of the angle irons oriented vertically so as to form sides to hold a flat floor 30 therebetween for supporting a wheelchair 32 thereon.

The pivotal connection of platform assembly 12 to housing 14 include three steel sleeves 34 affixed transversely on the underside of frame 18, and oriented with their axes axial to each other. Three housing-mounted sleeves 36 are affixed axial to the platform-mounted sleeves 34 and adjacent thereto. All of the sleeves 34 and 36 have a nylon/plastic bearing 38 therein. A steel rod 39 extends through all of the bearings 38 and acts as the pivotal axis for platform assembly 12. As shown in the drawings, the pivotal axis is located approximately 15 inches from the rearward end of a platform 12, the platform having a length of about 36 inches. These dimensions will cause the center of gravity of an occupied wheelchair on the platform to be located at the pivotal axis. The location of the pivotal axis should be located correspondingly on platforms of different sizes.

A loading ramp assembly, designated generally at 40, serves to load and help secure a wheelchair 32 on platform assembly 12. A piano hinge 42 has one leaf 44 attached to the bottom of forward end strap 26 with the hinge parallel to the forward edge thereof. The other leaf 46 of hinge 42 serves as a pivotal ramp. A lever 48 pivotally mounted near its middle to left side 22 has a link 50 pivotally connected to one end thereof. The other end of link 50 is pivotally connected to a flange 52 on the face of pivotal leaf 46. As the free end of lever 48 is moved so as to pivot lever 48, link 50 will pull leaf 46 upwards until it abuts the forward edges of the housing 14. The leaf 46 will thereby serve as a stop for the wheels of a wheelchair 32 located on floor 30 of platform assembly 12. Leaf 46 is lowered to act as a ramp by reversing this procedure.

A lock bar 54 may be utilized for further securement of a wheelchair on platform assembly 12. Lock bar 54 has clamping devices 56 on each end which are selectively fastenable to the projecting edges of sides 20 and 22 using a set screw or the like. Locking bar 54 is positioned against the large rear tires of wheelchair 32, once in position, and clamped in place.

Housing 14 includes a floor 58 which supports platform assembly 12 and extends beyond the sides 20 and 22 and rearward end 24 thereof. Right and left side panels 60 and 62 are slightly higher than the height of the platform 12 housed thereon. Each side panel 60 and 62 has a pair of handles 64 mounted thereon to allow for easy transport of the device 10. A rear panel 66 connects the side panels 60 and 62 and has four casters 68 mounted thereon. Thus, the entire rocking platform 10 may be tipped up onto its rearward end 66 so as to roll on casters 68. This vertical stance of the rocking platform 10 also reduces the space required to store the device. A cover 70 extends over the rearward ends of the floor 58 and side panels 60 and 62 up to the rearward end of platform assembly 12, so as to completely enclose the power train 16.

Figure 2:
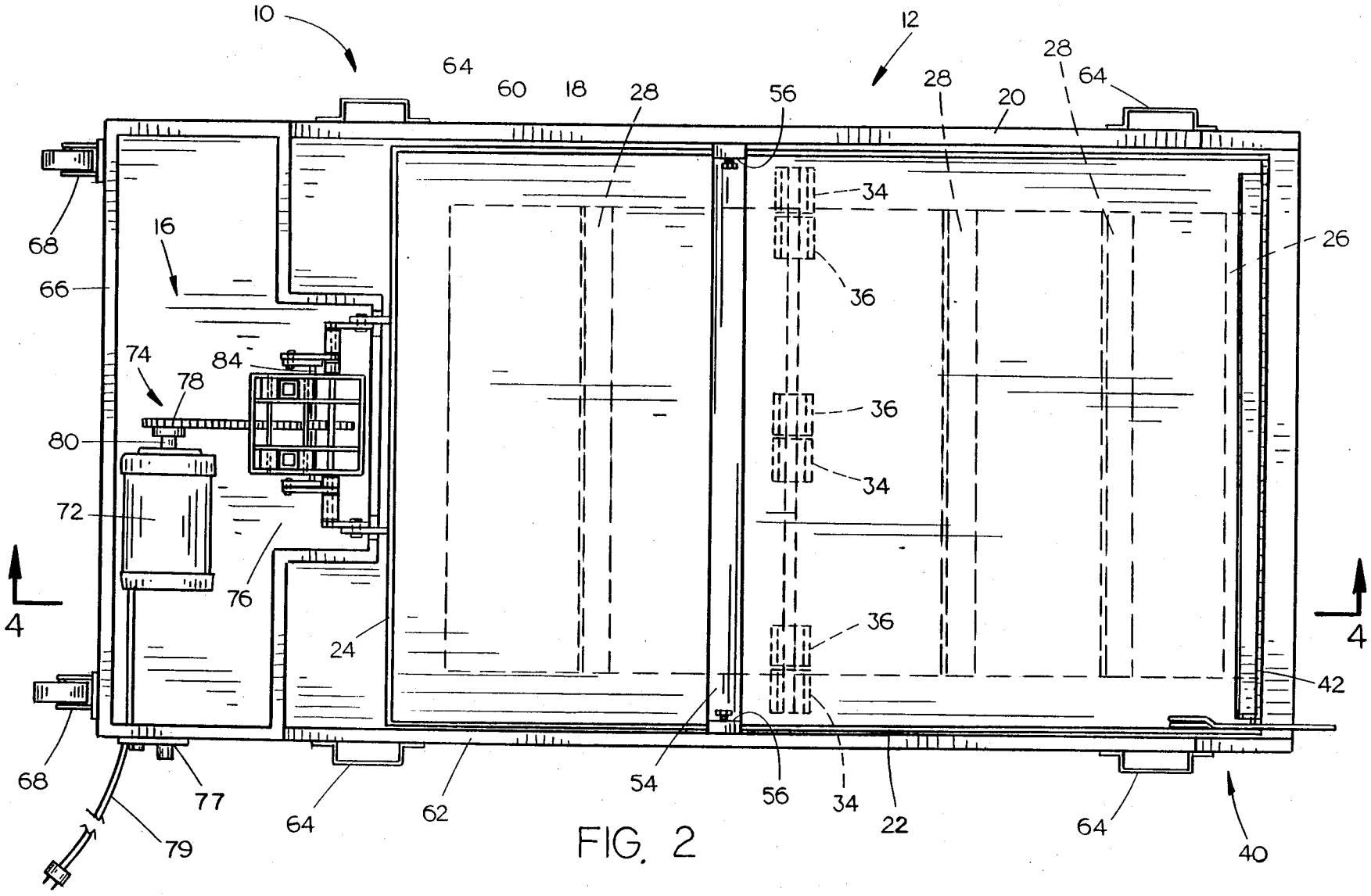
FIG. 2 is a top view of the invention.
Figure 3:
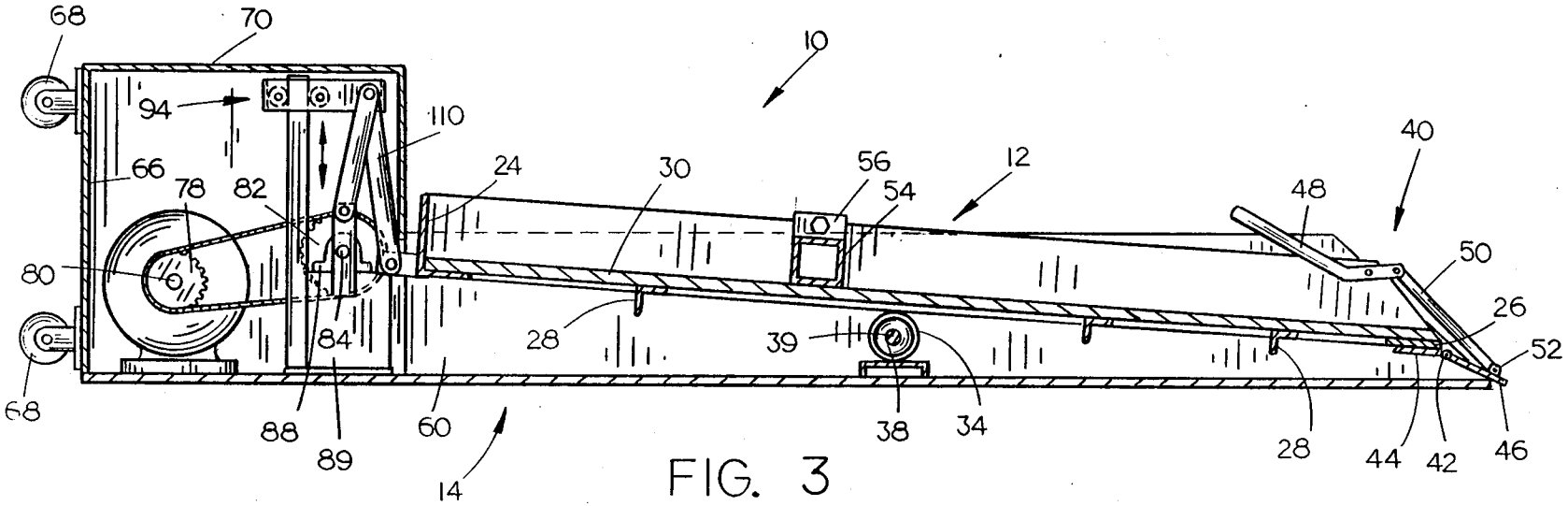
FIG. 3 is a sectional view taken at lines 3—3 in FIG. 2, and showing the invention in its loading position.
Figure 4:
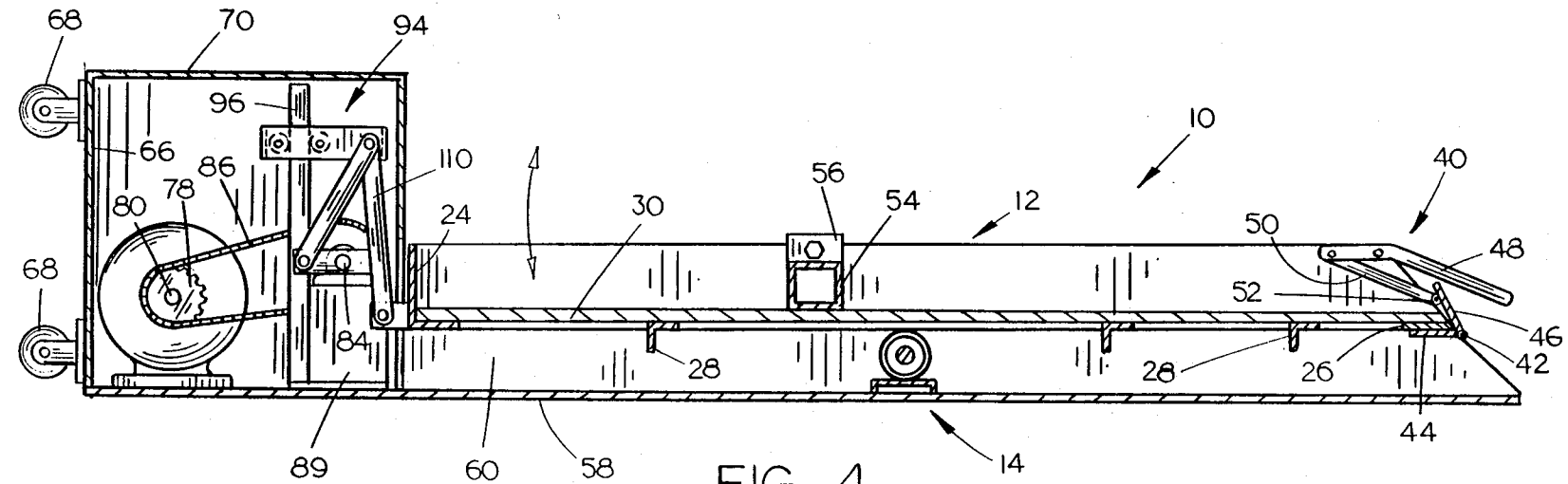
FIG. 4 is a sectional view taken at lines 3—3 in FIG. 2, and showing the invention in operating position.
Figure 5:
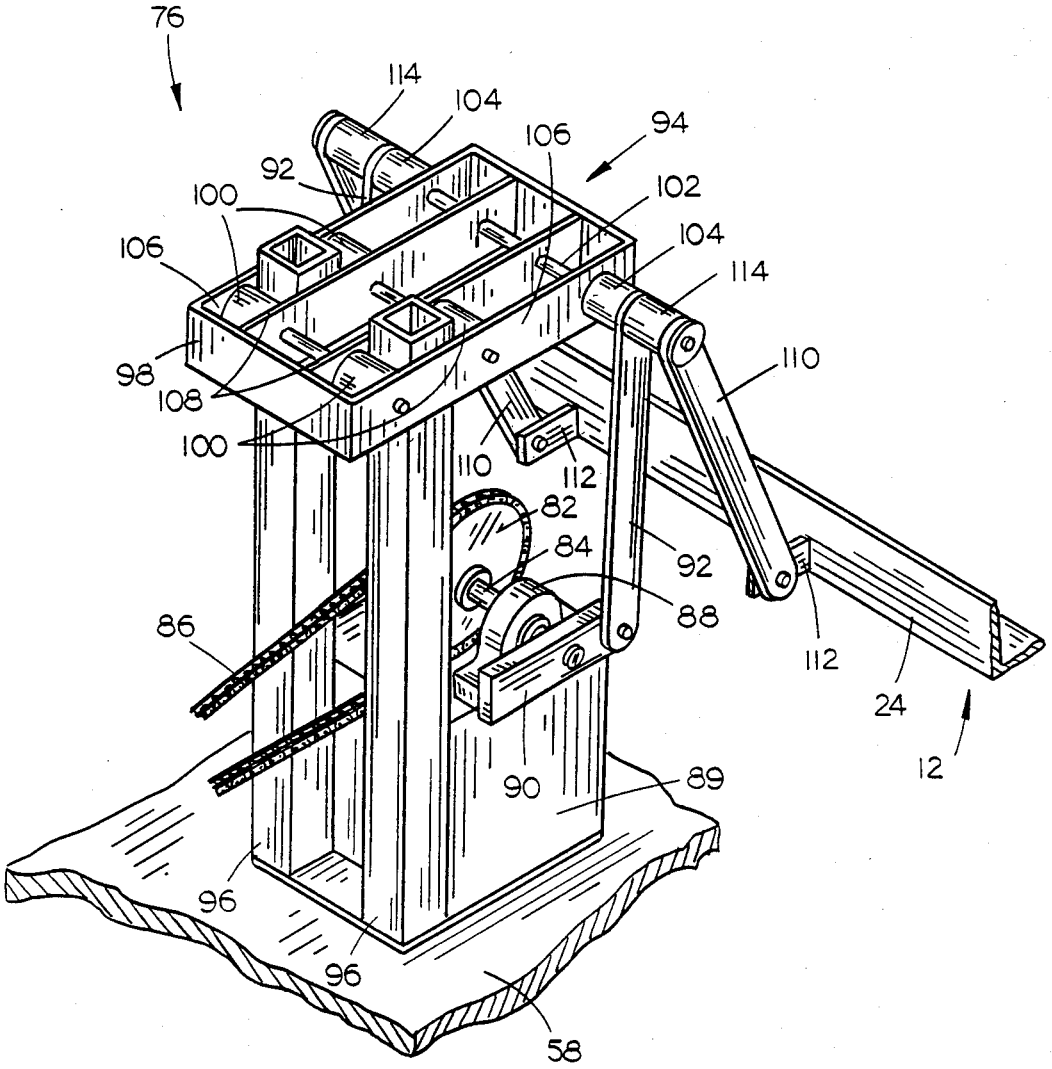
FIG. 5 is an enlarged perspective view of a portion of the power train of the invention.

Referring now to FIGS. 2–5, the power train 16 includes an electric motor 72 which powers a gear and sprocket arrangement 74, and a power conversion assembly 76 which converts rotary power into reciprocating movement. An electrical switch 77 is mounted on housing 14 and serves to activate and de-activate the device 10. An electric cord 79 extends from motor 72 and housing 14, and will connect to a convenient outlet to power the device 10.

Motor 72 is mounted to the rearward end of housing 14 and has a drive gear 78 mounted on its drive shaft 80. A larger sprocket 82 mounted on an axle 84 parallel to drive shaft 80 is connected to drive gear 78 via a chain 86. Axle 84 is rotatably mounted between a pair of pillow block bearings 88 fastened to a support structure 89 on housing floor 58.

An eccentric 90 is mounted on each end of axle 84, for rotation therewith. Each eccentric 90 is generally rectangular in shape and is fastened at its mid-point to axle 84. The end of a drive rod 92 is rotatably connected to one end of each eccentric 90, the other end being pivotally connected to a guide assembly 94. Guide assembly 94, described below, restricts the upper end of drive rod 92 to a vertical path, such that rotation of eccentric 90 will cause the upper end of drive rod 92 to reciprocate vertically, thereby converting the rotational action of the eccentric 90 to reciprocating motion at the upper end of drive rod 92. The end of eccentric 90 opposite the end connected to drive rod 92 serves to maintain a steady motion as the eccentric 90 rotates, thereby giving a kind of flywheel action to the power train 16.

Guide assembly 94 includes a pair of vertical, square guide tubes 96 which project from housing floor 58. A rectangular frame 98 has two pairs of horizontally spaced-apart rollers 100 rotatably mounted thereon, and located such that each pair of rollers 100 is disposed on opposite sides of each square guide tube 96 and in rolling contact therewith. Because the rollers 100 are in rolling contact with guide tubes 96, the rectangular frame 98 is held in a horizontal plane or orientation, yet is capable of vertical movement. Side members 106 of rectangular frame 98 are a distance apart only slightly greater than the distance between the outermost faces of the two guide tubes 96, so that rectangular frame 98 is restrained from lateral movement. A pair of intermediate straps 108 support rollers 100 and maintain them in their lateral position in rolling contact with vertical guide tubes 96.

A pivot rod 102 projects horizontally through apertures in rectangular frame 98 and through the ends of each drive rod 92, such that drive rods 92 will reciprocate simultaneously and in alignment. Spacers 104 on pivot rod 102 between drive rods 92 and rectangular frame 98 resist any tendency for drive rods 92 to move laterally along pivot rod 102. A linkage arm 110 is pivotally connected at one end to each end of pivot rod 102, and at the other end to a flange 112 affixed to the rearward end 24 of platform assembly 12. Linkage arms 110 transmit the reciprocating motion of the upper end of drive rods 92 to platform assembly 12. A pair of spacers 114 separate the drive rods 92 from the linkage arms 110 on pivot rod 102, so that they will not interfere with one another.

In operation, motor 72 will rotate sprocket 82 via chain 86 and drive gear 78. This in turn will rotate the eccentric 90 on axle 84. The lower end of drive rod 92 will rotate on the end of eccentric 90 causing the upper ends to reciprocate vertically. The linkage arms 110 transmit this reciprocating action to the platform assembly 12 causing it to pivot about its pivotal axis. A wheelchair 32 on the platform assembly 12 will thereby be rocked in a manner analogous to the motion of a rocking chair.

It can therefore be seen that the invention fulfills at least all of the above-stated objectives.

I claim:

1. A rocking platform for rocking a wheelchair and occupant with a rocking-chair motion, comprising:

a base housing having a forward portion and rearward portion;

a platform, having right and left sides, forward and rearward ends and upper and lower surfaces, operatively, pivotally connected to the forward portion of said base housing;

means for pivotally mounting said platform on said forward portion of said base housing, said mounting means being affixed to the lower surface of said platform intermediate the forward and rearward ends of the platform and extending substantially from side to side, such that the pivotal axis of the platform is affixed horizontally, transversely and substantially centrally between the forward and rearward ends of said platform;

power means mounted in the rearward portion of said base housing and the connected to said platform to rock said platform about said pivotal axis, the forward and rearward ends of said platform moving generally vertically; and retractable ramp means operably, pivotally attached to the forward end of said platform and operable between an extended loading position and a retracted wheelchair-securing position.

2. The rocking platform of claim 1, wherein said rearward portion of said base housing has a vertical rearward end, said housing having an operable position and a storage position, said housing having a generally horizontal ground-engaging side engaging the ground when in said operable position, and further comprising wheel means mounted on the rearward vertical end of said housing and operable to movably support said housing when in the storage position with said housing being stood vertically on its rearward end.

3. The rocking platform of claim 2, further comprising handle means affixed to each side of said housing, whereby the rocking platform may be easily carried and tipped onto its rearward end.

4. The rocking platform of claim 1, further comprising an upwardly projecting stop means affixed along the rearward end of said platform, to secure a wheelchair from rolling rearwardly on the platform.

5. The rocking platform of claim 4, further comprising securement means connected to said platform to secure a wheelchair from rolling forward on the platform.

6. The rocking platform of claim 4, wherein said securement means includes a lock bar and means for selectively attaching said lock bar in a fixed position forward of and abutting the rearward wheels of a wheelchair on said platform.

7. The rocking platform of claim 4, wherein said power means includes:

motor means mounted in said housing, said motor having a powered drive shaft; and eccentric means connecting said drive shaft and platform, adapted to convert the rotary power of said drive shaft into reciprocating motion and transmit that motion to said platform.

8. The rocking platform of claim 1, wherein said mounting means is affixed to said platform rearwardly of, and proximal to the longitudinal center of said platform, such that said pivotal axis is disposed generally vertically below the center of gravity of an occupied wheelchair on said platform.

* * * * *